United States Patent [19]

Helmreich et al.

[11] Patent Number: 4,909,240

[45] Date of Patent: Mar. 20, 1990

[54] ULTRASOUND HEAD WITH REMOVABLE RESONATOR ASSEMBLY

[75] Inventors: Klaus Helmreich, Erlangen; Rolf Langensiepen, Grasellenbach, both of Fed. Rep. of Germany

[73] Assignee: Siemens Aktiengesellschaft, Berlin and Munich, Fed. Rep. of Germany

[21] Appl. No.: 165,549

[22] Filed: Mar. 8, 1988

[30] Foreign Application Priority Data

Mar. 20, 1987 [DE] Fed. Rep. of Germany ... 8704183[U]

[51] Int. Cl.[4] ..... A61H 23/02

[52] U.S. Cl. ..... 128/24 A; 310/334; 73/644

[58] Field of Search ..... 128/24 A; 73/642, 644; 310/324, 327, 336, 334

[56] References Cited

U.S. PATENT DOCUMENTS 2,460,153 7/1946 Smoluchowski ..... 310/336
2,917,042 12/1959 Brown et al. .
3,845,332 10/1974 Lest .
4,173,725 11/1979 Asai et al. .
4,269,176 5/1981 Beyer et al. ..... 128/24 A
4,387,720 6/1983 Miller .
4,700,100 10/1987 Congdon et al. ..... 310/324
4,705,981 11/1987 Inoue et al. ..... 310/324
4,811,740 3/1989 Ikeda et al. ..... 128/662.03

*Primary Examiner*—Ruth S. Smith
*Assistant Examiner*—John D. Zele
*Attorney, Agent, or Firm*—Hill, Van Santen, Steadman & Simpson

[57] ABSTRACT

An ultrasound head of the type suitable for medical ultrasound therapy has a housing with an opening in which a resonator assembly is insertable. The resonator assembly is mounted in the opening of the housing so as to be removable. The assembly includes a carrier for a ceramic resonator disc, the carrier having an outwardly flanged edge which is received against an inside shoulder of the housing surrounding the opening, so that the carrier projects at least partially out of the opening. A pressing mechanism is provided for maintaining the assembly tight against the inside shoulder by applying pressure from the interior of the housing.

8 Claims, 1 Drawing Sheet

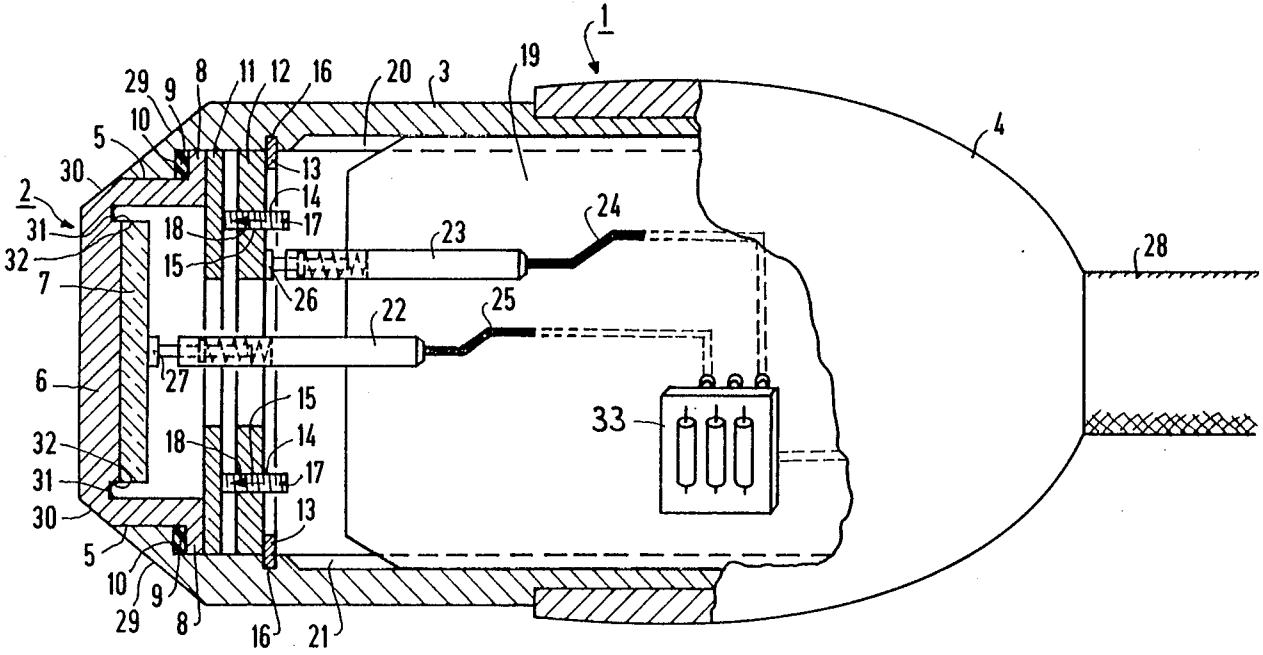
28
4
1
19
3
20
16
12
11
8
9
29
10
5
30
2
31
32
7
6
32
31
30
5
10
29
9
8
16
21
13
14
17
26
15
18
27
18
15
14
17
13
24
25
23
22
33

ULTRASOUND HEAD WITH REMOVABLE RESONATOR ASSEMBLY

BACKGROUND OF THE INVENTION

Field of the Invention

The present invention is directed to an ultrasound head of the type suitable for use in medical ultrasound therapy, and in particular to such an ultrasound head having a removable resonator assembly.

Related Application:

The subject matter of the present application is related to the subject matter of an application entitled "Ultrasound Generator and Emitter," Herzog et al., Ser. No. 165,548 filed simultaneously herewith.

Description of the Prior Art

An ultrasound head suitable for combined ultrasound and stimulation therapy having a housing in which an ultrasound resonator is removably mounted, so as to be replaceable, is described in German OS 33 24 575. The resonator assembly in this known ultrasound head consists of a resonator carrier on which an ultrasound transducer in the form of a ceramic wafer is mounted. This carrier is held by a membrane at a second carrier, which can be screwed into an opening of the ultrasound head.

SUMMARY OF THE INVENTION

It is an object of the present invention to provide an ultrasound head with a removable resonator assembly which permits rapid replacement of the resonator assembly.

It is a further object of the present invention to provide such an ultrasound head which permits a higher amount of material to be saved upon replacement of the resonator assembly.

The above objects are achieved in accordance with the principles of the present invention in an ultrasound head having a housing with an opening therein in which the resonator assembly is mounted. The assembly includes a carrier having an outwardly flanged edge which is seated against an inside shoulder of the housing, so that the carrier projects at least partially out of the housing opening. A pressing mechanism is provided inside the housing for maintaining the carrier in a tight fit against the inside shoulder of the housing. The structure for the resonator head disclosed and claimed herein permits the resonator assembly to be replaced extremely rapidly. Moreover, in contrast to conventional ultrasound heads having a removable resonator assembly, the structure disclosed herein permits more components to be saved upon replacement of the resonator assembly, since only the resonator carrier with the ceramic disc mounted thereon are removed and replaced.

DESCRIPTION OF THE DRAWINGS

The single FIGURE is a side view of an ultrasound head constructed in accordance with the principles of the present invention, shown partly in section.

DESCRIPTION OF THE PREFERRED EMBODIMENTS

The embodiment of the ultrasound head 1 shown in the drawing has an ultrasound resonator assembly 2 mounted in a proximal housing section 3 consisting of, for example, plastic. A distal housing section 4 also consisting, for example, of plastic engages the proximal housing section 3 in a by press fit. In the drawing, the proximal housing section 3 is substantially shown in longitudinal section, and the distal housing section 4 is shown partly broken away.

The proximal housing section 3 has an opening 5 at an application side thereof through which the ultrasound resonator assembly 2 projects from the inside of the ultrasound head 1. The resonator assembly 2 consists of a resonator carrier 6 consisting of, for example, aluminum, and a ceramic resonating wafer or disc 7 mounted thereon by suitable adhesive. The carrier 6 has an outwardly flanged edge 8 seated on an inside shoulder 10 of the proximal housing section 3 which surrounds the opening 5. A sealing ring 9 is disposed between the edge 8 and the shoulder 10. A pressing mechanism is provided inside the ultrasound head 1 consisting of a thin, perforated metal disc 11 consisting of, for example, steel, a thick, perforated metal disc 12 also consisting, for example, of steel, a circular clip 13, and a number, for example, three, of metallic clamping screws 14. Each of the clamping screws 14 is received in a threaded bore 15 of the metal disc 12. As described below, tightening of the clamping screws 14 forces the carrier 6 against the sealing ring 9, and thus against the shoulder 10.

During assembly, the sealing ring 9 is first placed on the inside shoulder 10 of the proximal housing section 3. The resonator assembly 2 is then inserted into the opening 5 so as to assume the position shown in the drawing with the edge 8 adjacent the sealing ring 9. The thin perforated metal disc 11 and the thick perforated metal disc 12 are then inserted and the circular clip 13 is forced into an annular groove 16 in the interior of the proximal housing section 3. Each of the clamping screws 14 has a slot 17 for receiving the blade of a screwdriver. By turning the screws with the screwdriver, each clamping screw 14 moves in the direction of the arrow 18. The circular clip 13 serves as an abutment for the thick perforated metal disc 12, so that the total number of clamping screws 14 forces the thin metal disc 11, and thus the edge 8 of the carrier 6, against the sealing ring 9, and thus against the shoulder 10.

The distal housing section 4 contains a printed circuit board 19 on which the essential electrical components for the circuitry of the ultrasound head are mounted. When the distal housing section 4 is forced over the proximal housing section 3, after the clamping screws 14 have been adjusted, the printed circuit board 19 will be received within two interior grooves 20 and 21 of the proximal housing section 3.

Spring contact pins 22 and 23 are provided for making mechanical and electrical contact with the resonator assembly 2. The contact pins 22 and 23 are soldered to conductor runs 24 and 25 leading to a voltage supply (not shown), which supplies power to element 33 for driving ceramic disc 7. The contact pins 22 and 23 have respective spring-biased contact feet 26 and 27. The contact foot 27 of the contact pin 22 is in contact with the ceramic disc 7, and the contact foot 26 of the contact pin 23 is in electrical contact with the carrier 6 via the thick metal disc 12, the contact screws 14, and the thin metal disc 11. Thus when the housing sections 3 and 4 are forced together, the contact feet 26 and 27 of the contact pins 23 and 22 are respectively pressed against the metal disc 12 and the ceramic disc 7.

The ultrasound head 1 is provided with a cable 28 leading to the voltage supply (not shown) for generating an oscillating electrical signal to drive the ceramic disc 7 to resonate.

The distal housing section 4 has an oblique exterior surface 29 surrounding the opening 5. This surface is coplanar with an oblique surface 30 on that portion of the carrier 6 which projects from the opening 5. The surfaces 29 and 30 merge smoothly with each other so that contact gel applied to the application portion of the ultrasound head 1 can be easily wiped off. The ceramic disc 7 is mounted on an island within the interior of the carrier 6 which is formed by an annular groove 31. The groove 31 receives any excess adhesive, indicated at 32, when the ceramic disc 7 is mounted on the carrier 6. This prevents undesired cross-couplings when the ceramic disc 7 is driven to resonate.

In the event of a malfunction of the ceramic disc 7, the resonator assembly 2 (the carrier 6 together with the ceramic disc 7) are disassembled in the reverse sequence of that described above, and can thus be easily replaced by a new resonator assembly 2, with all of the other components still being re-useable.

Although modifications and changes may be suggested by those skilled in the art it is the intention of the inventors to embody within the patent warranted hereon all changes and modifications as reasonably and properly come within the scope of their contribution to the art.

We claim as our invention:

1. An ultrasound head comprising:

an housing having an opening therein with a inside shoulder surrounding said opening, said housing having an interior annular groove;

an ultrasound resonator assembly consisting of a carrier and a resonator disc attached thereto, said carrier having an outwardly flanged edge seated in said shoulder such that a portion of said ultrasound resonator assembly projects through said opening;

a circular clip received in said annular groove in said housing;

a first element disposed inside said housing and abutting said circular clip so that axial movement of said first element past said circular clip is prevented, said first element having a plurality of threaded bores therein;

a second element spaced from said first pressure element inside said housing and disposed against said carrier; and a plurality of screws respectively received in said bores of said first element and abutting said second element, said screws being turnable to move said second element toward said inside shoulder.

2. An ultrasound head as claimed in claim 1, further comprising:

a resilient sealing ring disposed between said edge of said carrier and said inside shoulder of said housing.

3. An ultrasound head as claimed in claim 1, wherein each of said first and second pressure elements are perforated discs.

4. An ultrasound head as claimed in claim 1, further comprising electrical means for driving said resonator disc, and wherein each of said first element, said second element, said screws and said carrier consist of metal and form a portion of an electrical signal conduction path between said resonator disc and said electrical means.

5. An ultrasound head as claimed in claim 4, further comprising:

a printed circuit board disposed in said housing having said electrical means mounted thereto;

a first spring contact pin electrically connected to said electrical means on said circuit board and mechanically and electrically connected to said resonator disc; and a second spring contact pin electrically connected to said electrical means on said circuit board and mechanically and electrically connected to said first pressure element.

6. An ultrasound head as claimed in claim 5, wherein said housing consists of a distal housing section in which said resonator assembly, said first and second elements and said circular clip are disposed, and a proximal housing section in which said printed circuit board and said spring contact pins are disposed, said distal and proximal housing sections being engaged in a press fit so that said first and second contact pins are forced respectively against said resonator disc and said first element.

7. An ultrasound head as claimed in claim 1, wherein said housing has an oblique exterior surface surrounding said opening, and wherein said portion of said resonator assembly projecting through said opening has an oblique surface coplanar with said oblique surface of said housing.

8. An ultrasound head as claimed in claim 1, wherein said resonator disc is mounted to said carrier by adhesive, and wherein said carrier has an annular groove therein surrounding said resonator disc disposed for receiving excess adhesive.

* * * * *